US007014565B2

(12) United States Patent
Chang

(10) Patent No.: US 7,014,565 B2
(45) Date of Patent: Mar. 21, 2006

(54) TOY BOWLING PIN WITH SOUNDING AND LIGHTING EFFECT

(76) Inventor: Mao Jong Chang, No. 4, Lane 191, Sec. 3, Minsheng Rd., Daya Township, Taichung County (TW)

( * ) Notice: Subject to any disclaimer, the term of this patent is extended or adjusted under 35 U.S.C. 154(b) by 176 days.

(21) Appl. No.: 10/704,656

(22) Filed: Nov. 12, 2003

(65) Prior Publication Data

US 2005/0101399 A1 May 12, 2005

(51) Int. Cl.
*A63D 9/00* (2006.01)

(52) U.S. Cl. ..... 473/118; 362/253; 446/485

(58) Field of Classification Search ..... 473/118, 473/119, 124; 362/362, 363, 375, 253; 446/485, 446/397; 273/460, 461
See application file for complete search history.

(56) References Cited

U.S. PATENT DOCUMENTS 5,102,131 A * 4/1992 Remington ..... 473/570
5,186,458 A * 2/1993 Redondo ..... 473/570
5,316,293 A * 5/1994 Hamilton ..... 473/570
5,775,800 A * 7/1998 Hsieh ..... 362/295
5,941,751 A * 8/1999 Johnson et al. ..... 446/213
6,155,700 A * 12/2000 Hsu ..... 362/363

OTHER PUBLICATIONS

Bowling Pin Lamp, Uncommon Goods Homepage, http://www.uncommongoods.com/item/item.jsp?catld=3&itemid=12086&_requestid=18805&OVRAW=bowling%2520pin%2520lights&OVKEY=bowling&OVMTC=standard, Jan. 1999.*
Chemical Light Products, Website, http://www.chemlite.com/products/static-item.asp?Item_ID=1539, May 2005.*

* cited by examiner

*Primary Examiner*—William M. Pierce
(74) *Attorney, Agent, or Firm*—Rosenberg, Klein & Lee

(57) ABSTRACT

A toy bowling pin includes a body made of semi-transparent material and has a hole longitudinally defined in the body. A cylinder is mounted in the bottom of the body and received in the hole in the body. An electric device partially received in the cylinder. The electric device includes a lighting element and a loudspeaker mounted thereon for providing lighting effect and sounding effect to the toy bowling pin.

10 Claims, 3 Drawing Sheets

TOY BOWLING PIN WITH SOUNDING AND LIGHTING EFFECT

BACKGROUND OF THE INVENTION

1. Field of the Invention

The present invention relates to a toy bowling pin, and more particularly to a toy bowling pin with sounding and lighting effect for promoting amusements.

2. Description of Related Art

As well know, the bowling uses a ball to strike pins. It may be a monotonous game to a child. The amusements of bowling for a child need to be promoted.

The present invention has arisen to mitigate and/or obviate the disadvantages of the conventional toy bowling pin.

SUMMARY OF THE INVENTION

The main objective of the present invention is to provide an improved toy bowling pin that contains lighting effect and sounding effect.

To achieve the objective, the toy bowling pin in accordance with the present invention comprises a body made of semi-transparent material and has a hole longitudinally defined in the body. A cylinder is mounted in the bottom of the body and received in the hole in the body. An electric device partially received in the cylinder. The electric device includes a lighting element and a loudspeaker mounted thereon for providing lighting effect and sounding effect to the toy bowling pin.

Further benefits and advantages of the present invention will become apparent after a careful reading of the detailed description with appropriate reference to the accompanying drawings.

DETAILED DESCRIPTION OF THE INVENTION

Figure 1:
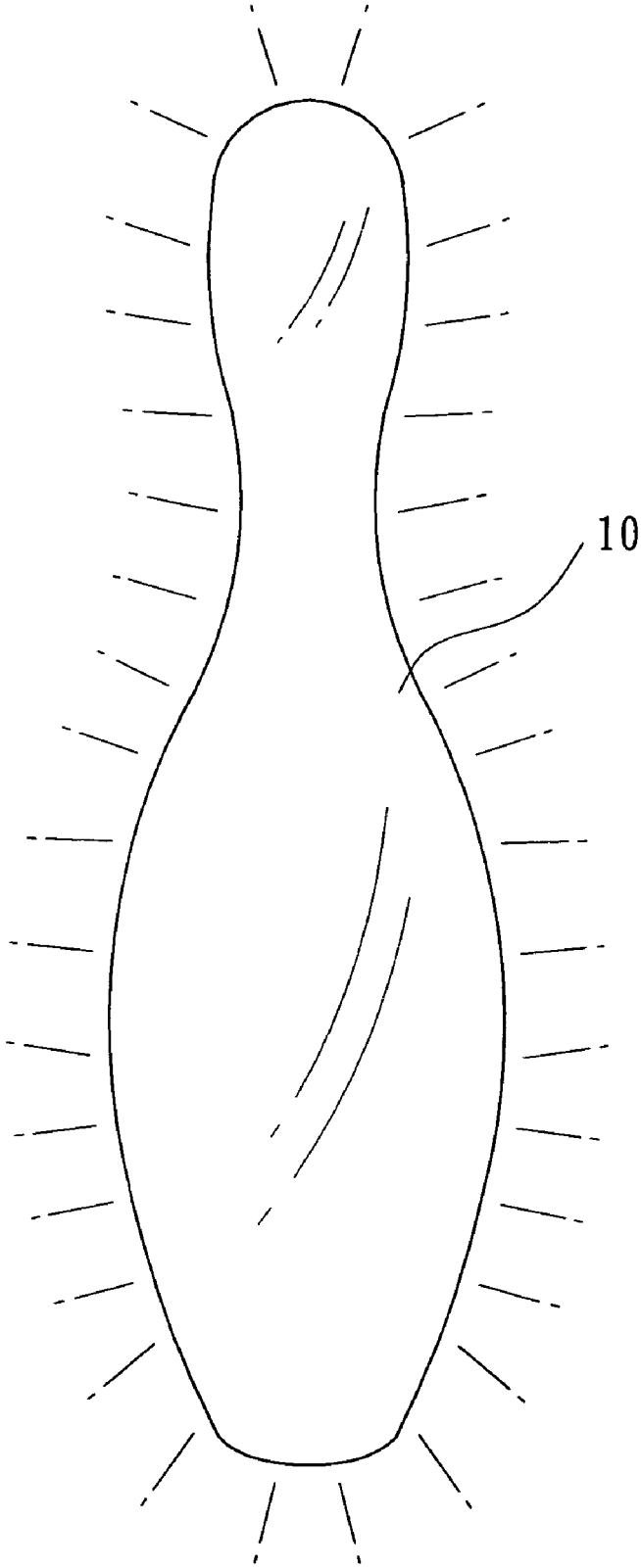
FIG. 1 is a perspective view of a toy bowling pin with sounding and lighting effect in accordance with the present invention.
Figure 2:
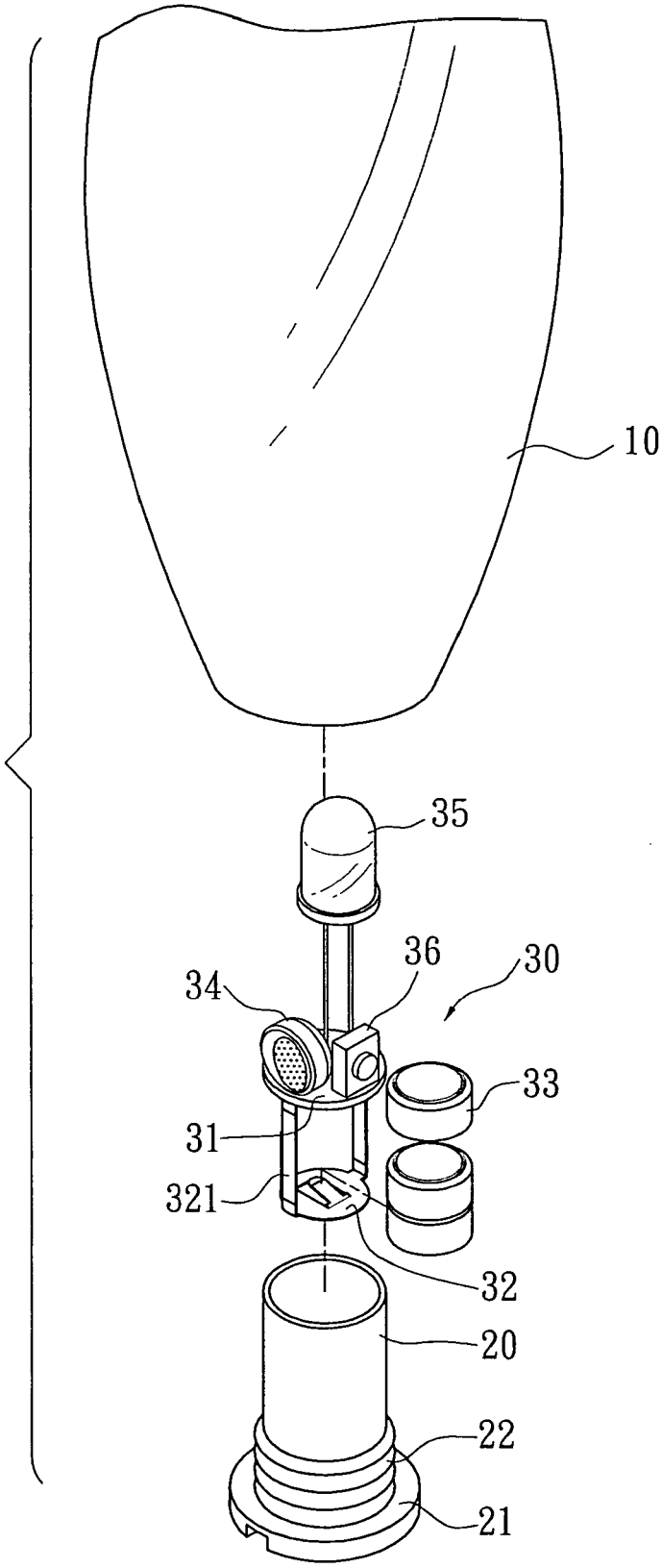
FIG. 2 is an exploded perspective view of the toy bowling pin in FIG. 1.
Figure 3:
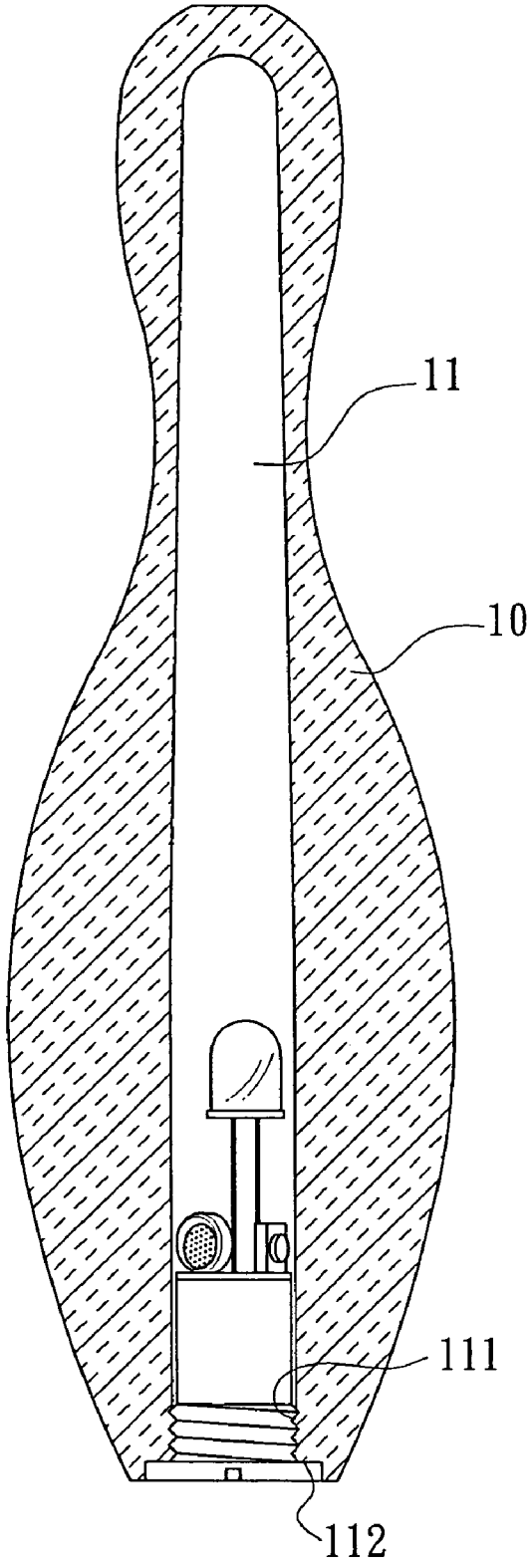
FIG. 3 is a partially cross-sectional view of the toy bowling pin in FIG. 1.

Referring to the drawings and initially to FIGS. 1–3, a toy bowling pin with sounding and lighting effect in accordance with the present invention comprises a body (10), a cylinder (20) longitudinally mounted in a bottom of the body (10) and electric device (30) partially received in the hood (20).

The body (10) is made of semi-transparent material. The body (10) includes a hole (11) longitudinally defined in the body (10) and having an open end formed on the bottom of the body (10). The hole (11) has a threaded section (111) formed on an inner periphery of open end of the hole (11) in the body (10). A recess (112) is defined in the bottom of the body (10) and centrally communicating with the hole (11) in the body (10).

The cylinder (20) is screwed into and received in the hole (11) in he body (10). The cylinder (20) includes a lower close bottom having a protrusion (21) laterally extending from the cylinder (20). The protrusion (21) is received in the recess (112) in the bottom of the body (10) when the cylinder (20) is longitudinally mounted to the body (10). The cylinder (20) includes a threaded portion (22) formed on an outer periphery thereof near the protrusion (21). The threaded portion (22) is screwed onto the threaded section (111) of the hole (11) in the body (10) to prevent the cylinder (20) from detaching from the body (10).

The electric device (30) is partially received in the cylinder (20) and the hole (11) in the body (10). The electric device (30) includes a circuit board (31) having a diameter slightly greater than that of the cylinder (20) so that the circuit board (31) closes the cylinder (20) when the electric device (30) mounted to the cylinder (20). The electric device (30) includes a bracket (32) longitudinally mounted to a first side of the circuit board (31). The bracket (32) is a conductor and electrically connected to a circuit on the circuit board (31). The bracket is received in the cylinder (20) when the electric device (30) is mounted to the cylinder (20). A power supplier (33) is mounted within the bracket (32) and used as a power source of the electric device (30). In the preferred embodiment of the present invention, the power supplier (33) is multiple piled mercury cells. The bracket (32) is partially sleeved with insulating tube (321) to prevent the bracket (32) from contacting with the periphery of the multiple piled mercury cells. The electric device (30) includes a loudspeaker (34) and a lighting element (35) respectively electrically mounted on a second side of the circuit board (31) for providing sounding and lighting effects. In the preferred embodiment of the present invention, the lighting element (35) is a LED. A recurrent switch (36) is electrically mounted on the circuit board (31) for controlling the lighting element (36) and the loudspeaker (34).

The lighting element (35) and the loudspeaker (34) of the present invention can respectively provide a lighting effect and a sounding effect for promoting the amusements of toy bowling. Especially in a dark environment, the lighting effect becomes remarkable and shows the user where the bowling pins are. Consequently, the toy bowling pins in accordance with the present invention can be played in a dark environment.

Although the invention has been explained in relation to its preferred embodiment, it is to be understood that many other possible modifications and variations can be made without departing from the spirit and scope of the invention as hereinafter claimed.

What is claimed is:

1. A toy bowling pin with sounding and lighting effect, comprising:

a body made of semi-transparent material and having a hole longitudinally defined in the body, the hole having an open end formed on a bottom of the body;

a cylinder mounted in the body and securely received in the open end of the hole, the cylinder having a lower closed bottom corresponding to that of the body; and an electrical device received in the cylinder and the hole in the body, the electrical device including:

a circuit board having a diameter slightly greater than that of the cylinder so that the circuit board closes the cylinder when the electric device is mounted to the cylinder;

a bracket longitudinally mounted to a first side of the circuit board, the bracket being received in the cylinder when the electric device is mounted to the cylinder;

a power supplier mounted within the bracket and used as a power source for the electric device;

a loudspeaker and a lighting element respectively electrically mounted on a second side of the circuit board for providing sounding and lighting effects; and a switch electrically mounted on the circuit board for controlling the lighting element and the loudspeaker.

2. The toy bowling pin as claimed in claim 1, wherein a threaded section is formed on an inner periphery of the open end of the hole in the body and a recess is defined in the bottom of the body, the recess centrally communicating with the hole in the body, the cylinder having a protrusion laterally extending from the lower closed bottom thereof and received in the recess in the body when the cylinder is mounted to the body, a threaded portion formed on an outer periphery of the cylinder near the protrusion and screwed onto the threaded section of the hole to prevent the cylinder from detaching from the body.

3. The toy bowling pin as claimed in claim 1, wherein the bracket is a conductor and the power supplier is multiple piled mercury cells.

4. The toy bowling pin as claimed in claim 1, wherein the lighting element is a LED.

5. The toy bowling pin as claimed in claim 2, wherein the bracket is a conductor and the power supplier is multiple piled mercury cells.

6. The toy bowling pin as claimed in claim 2, wherein the lighting element is a LED.

7. The toy bowling pin as claimed in claim 3, wherein the lighting element is a LED.

8. The toy bowling pin as claimed in claim 3, wherein the bracket is partially sleeved with insulating tube to prevent the bracket from contacting with the periphery of the multiple piled mercury cells.

9. The toy bowling pin as claimed in claim 5, wherein the bracket is partially sleeved with insulating tube to prevent the bracket from contacting with the periphery of the multiple piled mercury cells.

10. The toy bowling pin as claimed in claim 7, wherein the bracket is partially sleeved with insulating tube to prevent the bracket from contacting with the periphery of the multiple piled mercury cells.

* * * * *